US007555254B2

(12) United States Patent
Tateishi et al.

(10) Patent No.: US 7,555,254 B2
(45) Date of Patent: Jun. 30, 2009

(54) CLEANING DEVICE, AND FUSING DEVICE AND IMAGE FORMING APPARATUS, PROVIDED WITH THE CLEANING DEVICE

(75) Inventors: Yoshinobu Tateishi, Nara (JP); Toyoaki Nanba, Osaka (JP); Yasunori Minakuchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 340 days.

(21) Appl. No.: 11/680,687

(22) Filed: Mar. 1, 2007

(65) Prior Publication Data

US 2007/0212132 A1 Sep. 13, 2007

(30) Foreign Application Priority Data

Mar. 7, 2006 (JP) ..... 2006-061564

(51) Int. Cl.
*G03G 15/20* (2006.01)

(52) U.S. Cl. ..... 399/327

(58) Field of Classification Search ..... 399/327, 399/324, 320

See application file for complete search history.

(56) References Cited

U.S. PATENT DOCUMENTS

2005/0042003 A1* 2/2005 Matsumoto ..... 399/327

FOREIGN PATENT DOCUMENTS

JP 2001-5327 1/2001
JP 2003-107952 4/2003
JP 2006201380 A * 8/2006

* cited by examiner

*Primary Examiner*—Susan S Lee
(74) *Attorney, Agent, or Firm*—Renner, Otto, Boisselle & Sklar, LLP

(57) ABSTRACT

A cleaning device includes a cleaning web, a supply roller, a take-up roller, and a control section. Positioned in contact with a circumferential surface of a fuser roller, the web removes toner particles on the circumferential surface. The supply roller has the web wound thereon. The take-up roller takes up the web withdrawn from the supply roller. The control section controls rotation of the take-up roller. The control section performs a first process of causing the take-up roller to take up a first length of the web each time a predetermined taking-up condition is satisfied. The control section also performs a second process, instead of the first process, of causing the take-up roller to take up a second length of the web each time after a first predetermined number of the first processes are performed.

9 Claims, 7 Drawing Sheets

FIG.5

| NUMBER OF TAKING-UP PROCESSES | NUMBER OF IMAGE FORMING PROCESSES | TAKING-UP LENGTH (mm) | VISUAL INSPECTION RESULT |
|---|---|---|---|
| 1 | 9 | 0.5 | NO STREAKS OF TONER |
| 2 | 18 | 0.5 | NO STREAKS OF TONER |
| 3 | 27 | 0.5 | FAINT STREAKS OF TONER APPEAR |
| 4 | 36 | 0.5 | FAINT STREAKS OF TONER APPEAR |
| 5 | 45 | 0.5 | FAINT STREAKS OF TONER APPEAR |
| 6 | 54 | 3.0 | NO STREAKS OF TONER |
| 7 | 63 | 0.5 | LITTLE STREAK OF TONER |
| 8 | 72 | 0.5 | LITTLE STREAK OF TONER |
| 9 | 81 | 0.5 | FAINT STREAKS OF TONER APPEAR |
| 10 | 90 | 0.5 | FAINT STREAKS OF TONER APPEAR |
| 11 | 99 | 0.5 | FAINT STREAKS OF TONER APPEAR |
| 12 | 108 | 3.0 | NO STREAKS OF TONER |
| ⋮ | ⋮ | ⋮ | ⋮ |

FIG.6

PRIOR ART

| NUMBER OF TAKING-UP PROCESSES | NUMBER OF IMAGE FORMING PROCESSES | TAKING-UP LENGTH (mm) | VISUAL INSPECTION RESULT |
|---|---|---|---|
| 1 | 9 | 0.5 | NO STREAKS OF TONER |
| 2 | 18 | 0.5 | NO STREAKS OF TONER |
| 3 | 27 | 0.5 | FAINT STREAKS OF TONER APPEAR |
| 4 | 36 | 0.5 | FAINT STREAKS OF TONER APPEAR |
| 5 | 45 | 0.5 | FAINT STREAKS OF TONER APPEAR |
| 6 | 54 | 0.5 | STREAKS OF TONER APPEAR |
| 7 | 63 | 0.5 | STREAKS OF TONER APPEAR |
| 8 | 72 | 0.5 | STREAKS OF TONER APPEAR |
| 9 | 81 | 0.5 | ⋮ |
| 10 | 90 | 0.5 | |
| 11 | 99 | 0.5 | |
| 12 | 108 | 0.5 | |
| ⋮ | ⋮ | ⋮ | |

FIG.7

PRIOR ART

| NUMBER OF TAKING-UP PROCESSES | NUMBER OF IMAGE FORMING PROCESSES | TAKING-UP LENGTH (mm) | VISUAL INSPECTION RESULT |
|---|---|---|---|
| 1 | 9 | 0.9 | NO STREAKS OF TONER |
| 2 | 18 | 0.9 | NO STREAKS OF TONER |
| 3 | 27 | 0.9 | NO STREAKS OF TONER |
| 4 | 36 | 0.9 | FAINT STREAKS OF TONER APPEAR |
| 5 | 45 | 0.9 | FAINT STREAKS OF TONER APPEAR |
| 6 | 54 | 0.9 | FAINT STREAKS OF TONER APPEAR |
| 7 | 63 | 0.9 | STREAKS OF TONER APPEAR |
| 8 | 72 | 0.9 | STREAKS OF TONER APPEAR |
| 9 | 81 | 0.9 | ▪ |
| 10 | 90 | 0.9 | ▪ |
| 11 | 99 | 0.9 | ▪ |
| 12 | 108 | 0.9 | |
| ▪ ▪ ▪ | ▪ ▪ ▪ | ▪ ▪ ▪ | |

CLEANING DEVICE, AND FUSING DEVICE AND IMAGE FORMING APPARATUS, PROVIDED WITH THE CLEANING DEVICE

CROSS REFERENCE

This Nonprovisional application claims priority under 35 U.S.C. § 119(a) on Patent Application No. 2006-061564 filed in Japan on Mar. 7, 2006, the entire contents of which are hereby incorporated by reference.

BACKGROUND OF THE INVENTION

The invention relates to a cleaning device for cleaning a fuser roller that fixes a toner image on recording paper, and a fusing device, and an image forming apparatus, provided with the cleaning device.

A recent type of cleaning device employs a roll of sheet of fiber cloth impregnated with oil for removing toner debris on an outer surface of the fuser roller (See JP 2003-107952A). This roll of fiber cloth sheet is referred to as a cleaning web. Generally, this type of cleaning device is provided with a supply roller with an unused cleaning web wound thereon, a take-up roller for pulling and taking up the web withdrawn from the supply roller, a tension roller for pressing a portion of the web against the fuser roller.

While the take-up roller is fixed, the web rubs at the outer surface of the rotating fuser roller, thereby removing toner particles that remain on the surface of the fuser roller. Most of the toner particles removed from the fuser roller develop up between the web and the surface of the fuser roller at the side of the take-up roller.

A specified length of the web is pulled by the take-up roller and wound thereon each time after a predetermined number of image forming processes are performed. As the web is pulled and wound, the developed-up toner particles adhere to the web and is thereby collected.

If the developed-up toner particles are larger in amount than the toner particles collected by the web, however, the developed toner particles are left uncollected. Since most cleaning webs are impregnated with silicon oil, toner particles that have been left uncollected for too long between the web and the fuser roller become slippery with the oil from the web. Thus, some of the slippery toner particles may pass through a gap between the fuser roller and the web and adhere to recording paper in touch with the fuser roller.

Meanwhile, if an increased length of the web is pulled by and wound on the take-up roller to avoid the above-described problem, consumption of the web undesirably increases.

A feature of the invention is to provide a cleaning device that prevents toner particles from being left uncollected for too long between a cleaning web and a fuser roller while preventing an increase in web consumption, and a fusing device, and an image forming apparatus, provided with the cleaning device.

SUMMARY OF THE INVENTION

A cleaning device according to an aspect of the invention is adapted, for use in an electrophotographic image forming apparatus, to clean a fuser roller provided in the apparatus. The cleaning device includes a cleaning web, a supply roller, a take-up roller, and a control section. Positioned in contact with a circumferential surface of a fuser roller, the web removes toner particles on the circumferential surface. The supply roller has the web wound thereon. The take-up roller takes up the web withdrawn from the supply roller.

The control section controls rotation of the take-up roller. The control section performs a first process of causing the take-up roller to take up a first length of the web each time a predetermined taking-up condition is satisfied. An example of the taking-up condition is that a second predetermined number of image forming processes are performed.

The control section also performs a second process, instead of the first process, of causing the take-up roller to take up a second length of the web each time after a first predetermined number of the first processes are performed.

The purpose of the second process is to collect toner particles developed up between the web and the fuser roller. The second process facilitates collection of developed-up toner particles between the web and the fuser roller that cannot be completely removed in the first process. The second length should be set sufficiently long for complete collection of the developed-up toner particles. However, setting the second length too long results in wasteful taking up of the web. As an example, the second length is set equal to a portion of a length of the web in contact with the fuser roller. Performing the second process constantly causes a long length of the web to be used. According to the aspect of the invention, however, the second process is performed only at regular intervals, and this allows a relatively short length of the web to be used.

BRIEF DESCRIPTION OF THE DRAWINGS

FIG. 5 is an explanatory drawing showing experimental results on a state of collected toner on the cleaning web when a taking-up process according to the embodiment of the invention is performed;

FIG. 6 is an explanatory drawing showing experimental results on a state of collected toner on a cleaning web provided in a type of conventional image forming apparatus when a series of image forming processes are performed by the conventional apparatus; and FIG. 7 is an explanatory drawing showing experimental results on a state of collected toner on a cleaning web provided in another type of conventional image forming apparatus when a series of image forming processes are performed by the conventional apparatus.

DETAILED DESCRIPTION OF THE INVENTION

Figure 1:
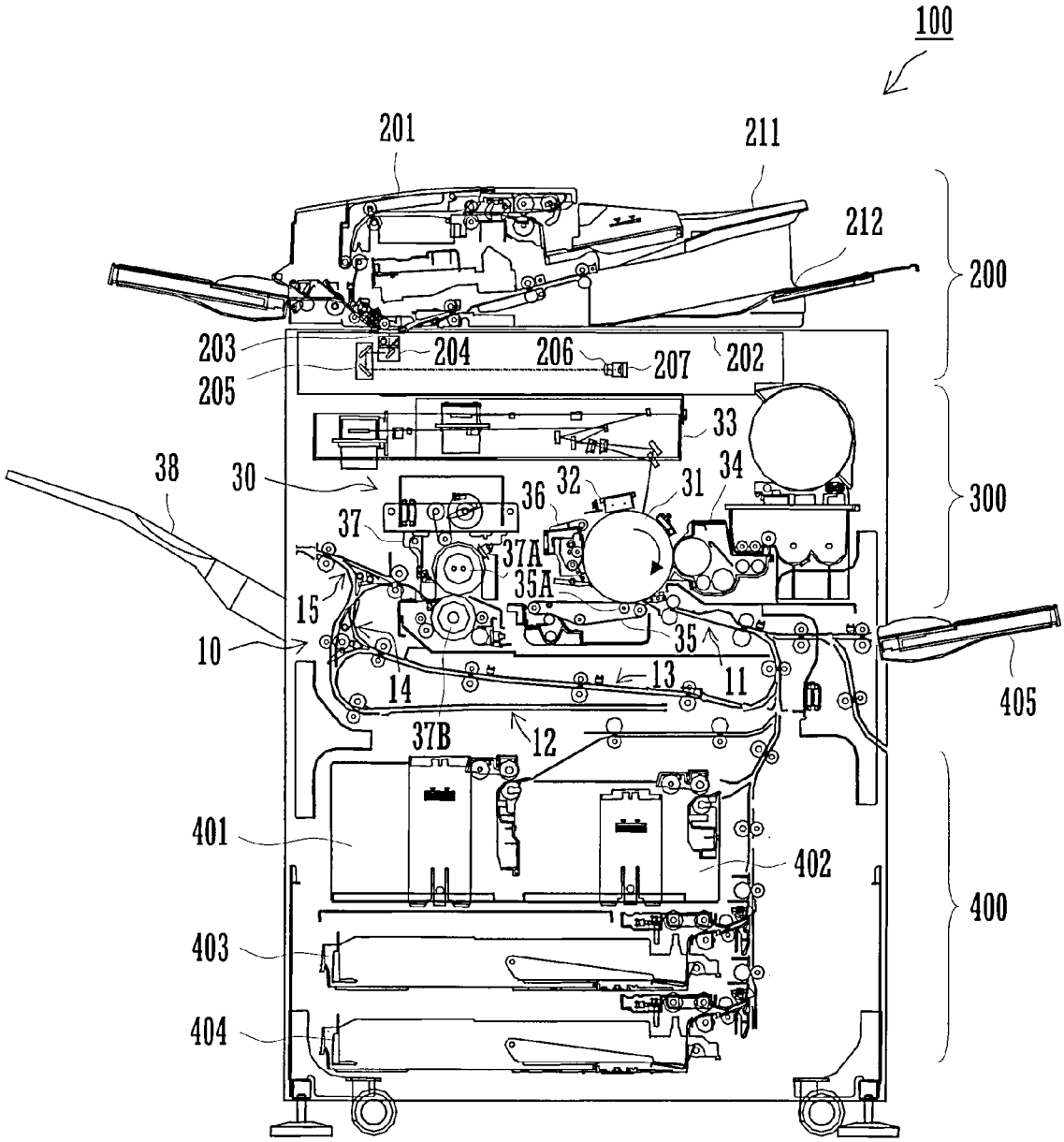
FIG. 1 is a drawing illustrating a schematic configuration of an image forming apparatus according to an embodiment of the invention.

With reference to the accompanying drawings, preferred embodiments of the invention will be described below. FIG. 1 is a schematic front cross-sectional view of an image forming apparatus according to an embodiment of the invention. An image reading unit 200 has an automatic document feeder (ADF) 201, a first document platen 202, a second document platen 203, a first mirror base 204, a second mirror base 205, a lens 206, and a charge coupled device (CCD) 207. In place of the CCD 207, a light-receiving element of another type may be used.

The ADF 201 feeds an original document, sheet by sheet, from a document tray 211 through the second document platen 203 to a first output tray 212. The ADF 201 is mounted pivotably about a rear-end pivot between an open position and a closed position. In the closed position, the ADF 201 covers the platen 202. The ADF 201 is pivoted upward to the open position to expose the platen 202, so that a user can place an original document manually on the platen 202.

Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

When an image of original document being transported by the ADF 201 is read, the base 204 is held still below the platen 203. While passing on the platen 203, an original document is irradiated with light from the light source. The reflected light is in turn reflected from the first mirror to the base 205.

When an image of original document placed on the platen 202 is read, the bases 204 and 205 are moved horizontally below the platen 202. An original document placed on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs an electric signal according to an amount of the reflected light from the original document. The electric signal is input to an image forming unit 300 as image data.

The unit 300 is provided with an image forming section 30. The section 30 includes a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow. The charging device 32 applies to the surface of the drum 31 such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1 * 10^9$ Ω·cm to $1 * 10^{13}$ Ω·cm. Inside the loop of the belt 35, a transfer roller 35A is positioned in pressure contact with the drum 31 through the belt 35. A predetermined amount of transfer voltage is applied to the roller 35A, so that a toner image is transferred from the drum 31 to recording paper being passed between the belt 35 and the drum 31.

The cleaner 36 removes toner debris on the drum 31 after a toner image is transferred from the drum 31 to recording paper.

The device 37 heats and pressurizes recording paper being passed therethrough, thereby firmly fixing a toner image to the paper. After passing through the device 37, the paper is output to a second output tray 38 mounted on a side surface of the apparatus 100.

A sheet feeding unit 400 has sheet cassettes 401, 402, 403, and 404, and a manual sheet feeding tray 405. Each of the cassettes 401 to 404 holds a plurality of sheets of recording paper of the same size. The tray 405 is provided for holding recording paper of sizes and types that are less frequently used.

The unit 400 feeds recording paper, sheet by sheet, from any one of the cassettes 401 to 404 and the tray 405. Recording paper fed by the unit 400 is transported to the image forming section 30 on a recording paper transport path 10. The path 10 includes a first path 11, a second path 12, a third path 13, a fourth path 14, and a fifth path 15.

Figure 2:
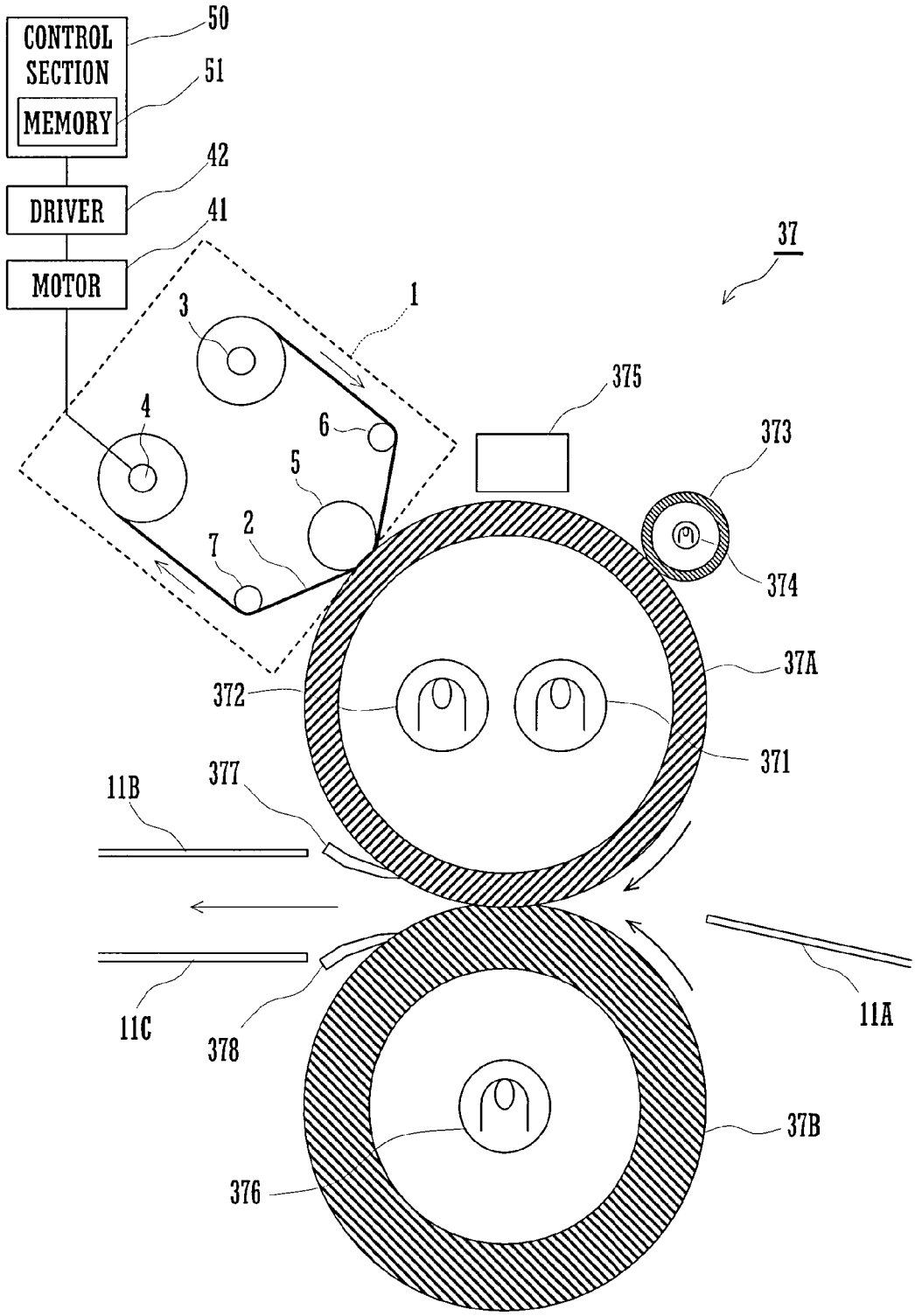
FIG. 2 is a drawing illustrating a configuration of a fusing device according to the embodiment of the invention.

Referring to FIG. 2, the fusing device 37 has a heat roller 37A, an external heat roller 373, a pressure roller 37B, a thermistor 375, a cleaning device 1, and stripper fingers 377 and 378. In the proximity of the device 37, guides 11A to 11C are provided for guidance of recording paper.

The heat roller 37A has internal heater lamps 371 and 372. The external heat roller 373 has an internal heater lamp 374. The roller 373 is positioned with a circumferential surface in contact with a circumferential surface of the roller 37A.

The thermistor 375 detects the surface temperature of the roller 37A.

The pressure roller 37B has an internal heater lamp 376. The roller 37B is pressed against the roller 37A at a predetermined pressure.

The roller 37A is heated to a temperature sufficient to melt toner ranging from 180 to 200 degrees C. by the lamps 371 and 372 and the roller 373. Meanwhile, the roller 37B is heated to a temperature of approximately 150 degrees C. by the lamp 376.

The fingers 377 and 378 prevent recording paper from sticking to the respective surfaces of the rollers 37A and 37B.

While passing between the rollers 37A and 37B, recording paper is heated and pressurized. In this process, a toner image transferred to the recording paper is fused and pressed into the paper. After passing between the rollers 37A and 37B, the paper is cooled down, so that the fused toner image is hardened and thus firmly fixed to the paper.

When the paper is passing between the rollers 37A and 37B, paper dust and some of toner particles adhere to the surface of the roller 37A.

The cleaning device 1 includes a cleaning web 2, a supply roller 3, a take-up roller 4, a pressure roller 5, tension rollers 6 and 7, a motor 41, a driver 42, and a control section 50.

The web 2 is withdrawn from the supply roller 3, travels along the tension roller 6, the pressure roller 5, and the tension roller 7, in that order, and is taken up by the take-up roller 4. The roller 3 has unused cleaning web 2 wound thereon. The roller 4 has the cleaning web 2 as used wound thereon. The pressure roller 5 is mounted in contact with the surface of the roller 37A through the web 2. The rollers 6 and 7 apply tension to the web 2. The motor 41 rotates the roller 4. The driver 42 drives the motor 41 based on a signal received from the control section 50.

The section 50 has control over the image forming apparatus as a whole. The section 50 has a memory 51. The section 50 causes the roller 4 to take up a first length of the web 2 each time after a second number of sheets of recording paper are passed between the rollers 37A and 37B. This process corresponds to the first process of the claims. Also, the section 50 causes the roller 4 to take up a second length of the web 2, instead of the first length, each time the number of times that the first length of the web 2 has been taken up reaches a first number. This process corresponds to the second process of the claims. The second length is set longer than the first length.

Figure 3:
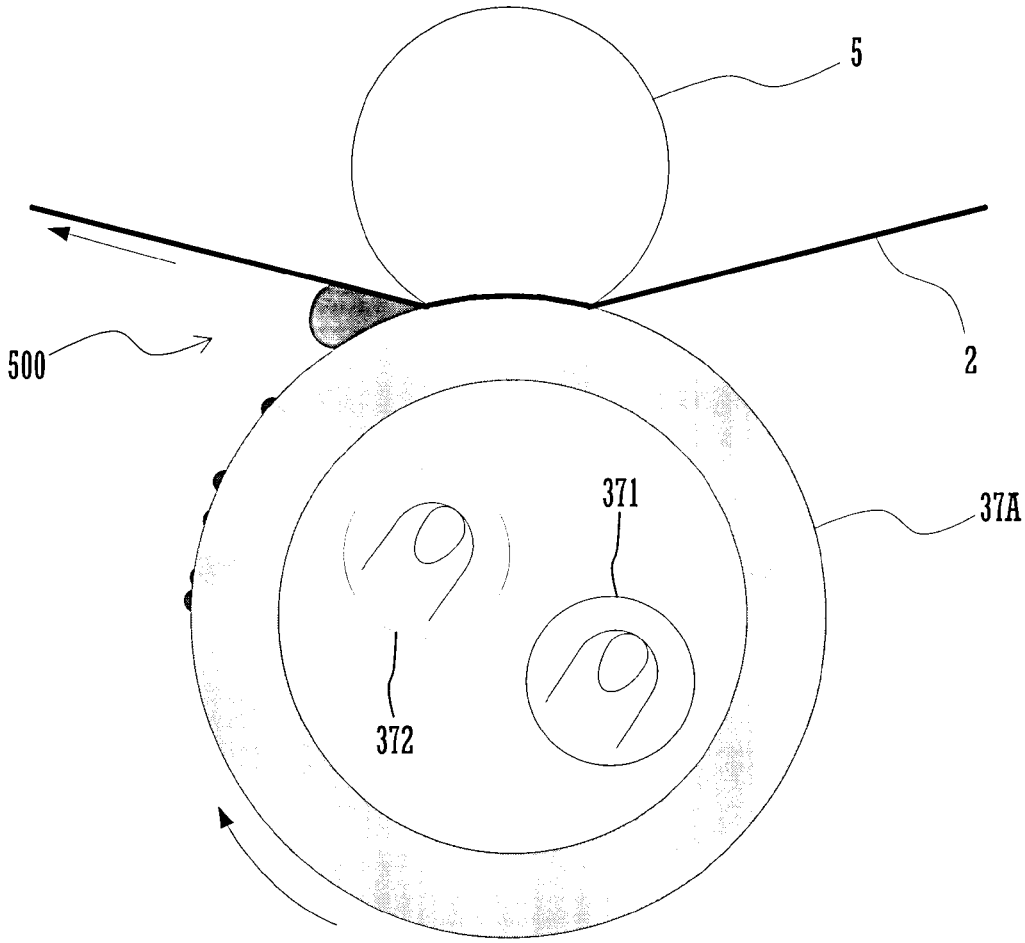
FIG. 3 is a partially enlarged view of the fusing device.

Referring to FIG. 3, the web 2 is pressed against the roller 37A in a cleaning position, with a contact area (a nip area) formed therebetween. While the roller 4 remains halted, the web 2 removes toner debris from the surface of the roller 37A. Some of the removed toner debris adhere to the web 2, and others develop up in a space 500 between the web 2 and the roller 37A. Then, the web 2 is taken up by the roller 4, and this movement causes the developed-up toner to adhere to the web 2, and, therefore, to be collected thereby.

It is preferable that the first and second numbers are set in such a manner as to prevent too much toner debris from developing up in the space 500, in consideration of the cleaning capability of the web 2 and the amount of toner debris generated per sheet of recording paper on which an image is formed.

Figure 4:
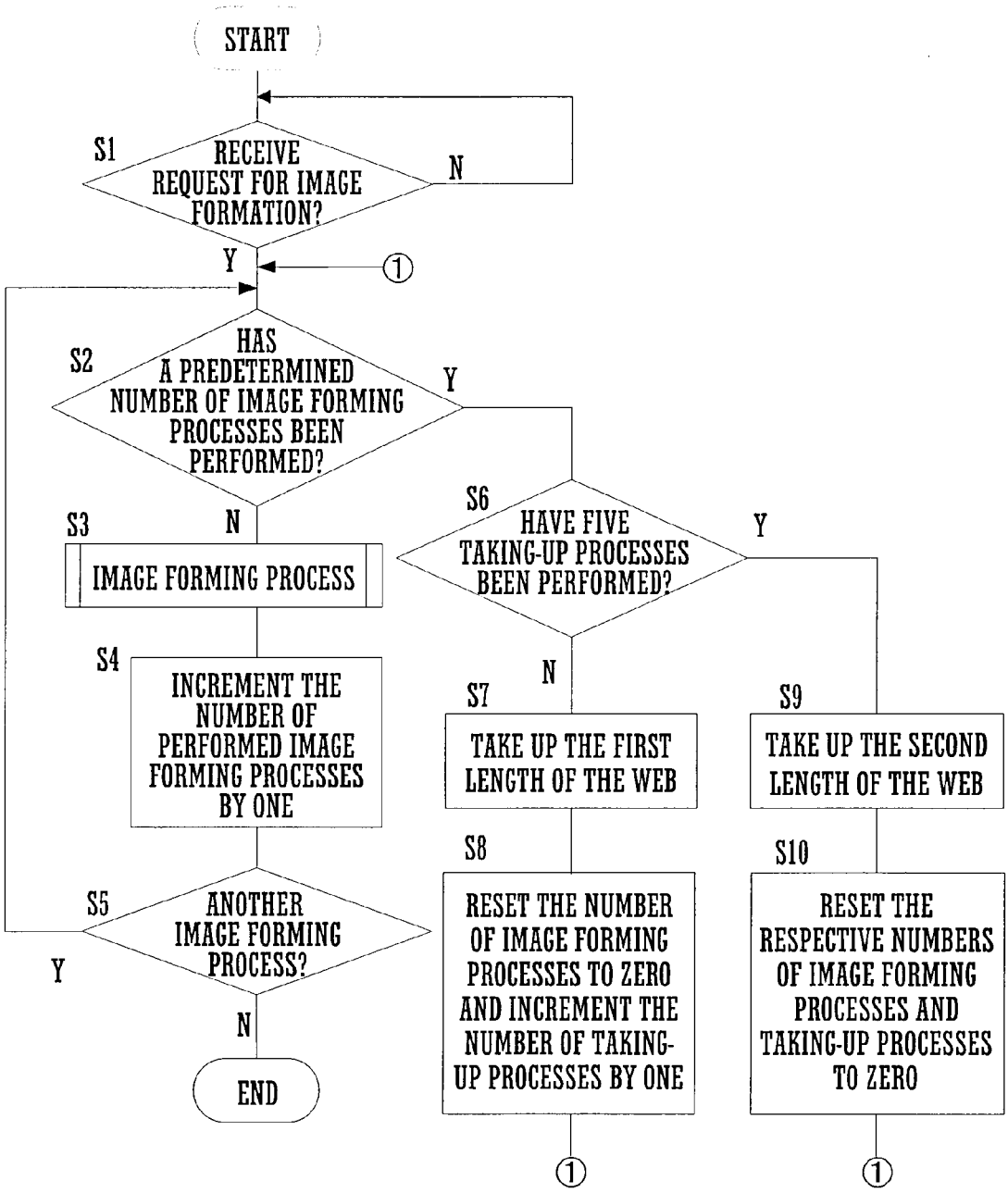
FIG. 4 is a flowchart illustrating steps of a process of taking up a cleaning web performed by a control section.

FIG. 4 is a flowchart illustrating steps of a process of taking up the web 2 performed by the section 50. The section 50 waits until an operating section (not shown) receives a request for image formation (step S1). When judging that a request for image formation is received, the section 50 determines whether the number of image forming processes having been performed reaches the second number (nine times in the present embodiment) (step S2). Specifically, the determination is made by comparing the number of performed image forming processes stored in the memory 51 with the second number.

When judging in step S2 that the stored number is smaller than the second number, the section 50 causes an image forming process to be performed on a sheet of recording paper (step S3), and updates the memory 51 to increment the stored number by one (step S4). Then, the section 50 determines whether there remains another image forming process to be performed (step S5). When judging that another request for image formation is received, the section 50 returns to step S2. If no request for image formation is received, the section 50 terminates the process.

When judging in step S2 that the stored number reaches the second number, meanwhile, the section 50 determines whether the number of performed processes of taking up the first length of the web 2 reaches the first number (five times in the present embodiment) (step S6). Specifically, the determination is made by storing in the memory 51 the number of taking-up processes, and comparing the stored number with the first number.

When judging in step S6 that the number of the taking-up processes is smaller than the first number, the section 50 causes the first length (0.5 mm in the present embodiment) of the web 2 to be taken up (step S7). Then, the section 50 updates the memory 51 to reset the stored number of performed image forming processes to zero and increment the stored number of taking-up processes by one (step S8), and proceeds to step S2.

When judging in step S6 that the number of performed taking-up processes reaches the first number, meanwhile, the section 50 causes the second length (3.0 mm in the present embodiment) of the web 2 to be taken up (step S9). Then, the section 50 updates the memory 51 to reset the respective stored numbers of image forming processes and taking-up processes to zero (step S10), and proceeds to step S2.

In the present embodiment, as described above, the determination as to whether the web 2 should be taken up is made for the duration of time between receipt of a request for image formation and start of image forming process. Alternatively, this determination may be made after an image forming process is performed.

FIG. 5 is an explanatory drawing showing experimental results on a state of collected toner on the cleaning web 2 when a series of image forming processes are performed by the apparatus 100 according to the present embodiment of the invention. FIGS. 6 and 7 are explanatory drawings showing experimental results on a state of collected toner on the cleaning web 2 provided in two types of conventional image forming apparatus when a series of image forming processes are performed by the conventional apparatus. As in the present embodiment, the conventional apparatus as shown in FIG. 6 causes the web 2 to be taken up by 0.5 mm, which is equal to the first length of the present embodiment, when the number of performed image forming processes reaches nine. The conventional apparatus as shown in FIG. 7 causes the web 2 to be taken up by 0.9 mm when the number of performed image forming processes reaches nine.

Each of the two types of conventional apparatus is otherwise similar in configuration to the apparatus 100 according to the present embodiment, and a portion of the web 2 in the contact area between the web 2 and the roller 37A is 3 mm in length. Also, the two types of apparatus perform the same image forming process on A4-size recording paper.

When the web 2 is taken up by rotation of the roller 4, toner debris adheres to the web 2 and is thus removed from the contact area. Since in the present embodiment the web 2 is white, a portion of the web 2 to which toner debris adheres becomes black, and forms a black line parallel to a fast scanning direction. As the web 2 is taken up and the toner debris on the web 2 is collected, there is no toner debris remaining in the space 500. Thus, the web 2 is taken up with no toner debris adhering thereto. A portion of the web 2 where no toner debris adheres maintains its original color and, therefore, forms a white line.

Then, when the web 2 is taken up again after another second number of image forming processes are performed, toner debris developed up in the space 500 causes another black line on the web 2.

When toner debris developed up in the space 500 is completely collected by taking up the web 2, more specifically, alternating black and white lines are formed on the web 2.

In the apparatus as shown in FIG. 6, a white line is not formed between the black lines, and faint streaks of toner begin to appear instead, approximately after the twenty-sixth image forming process. Approximately after the fifty-third image forming process, further, more and more streaks of toner appear, until the web 2 finally becomes blackened by toner.

These streaks of toner are formed by adhesion of toner particles to the web 2 in such a manner as to trail along a direction in which the web 2 is taken up. The streaks of toner decrease as toner particles developed up in the space 500 decrease. When there are no toner particles developed, a white line is formed, with nothing adhering to the web 2.

In the conventional apparatus shown in FIG. 6, more and more streaks of toner appear and, therefore, no white line is formed, after the twenty-sixth image forming process. This shows that developed-up toner particles in the space 500 are not completely removed, but gradually accumulated, even when the web 2 is taken up.

In the apparatus as shown in FIG. 7, a white line is not formed between the black lines, and faint streaks of toner begin to appear instead, approximately after the thirty-fifth image forming process. Approximately after the sixty-second image forming process, further, more and more streaks of toner appear, until the web 2 finally becomes blackened by toner.

Compared to the apparatus of FIG. 6, the apparatus of FIG. 7 allows more image forming processes to be performed until appearance of streaks of toner. Thus, the apparatus of FIG. 7 provides improved cleaning capability, with taking-up length being 0.9 mm per each taking-up process. However, toner particles developed up in the space 500 are not completely removed in a single taking-up process. This apparatus takes longer to develop the streaks of toner, but eventually produces similar results to those as shown in FIG. 6.

Referring to FIG. 5, meanwhile, the image forming apparatus of the present embodiment develops faint streaks of toner on the web 2, with no white line recognizable, after the first length of the web 2 is taken up. However, a white line is visible after the second length of the web 2 is taken up at regular intervals. In the present embodiment, thus, white lines are formed on the web 2 at the rate of one in every six taking-up processes.

The developed-up toner particles in the space 500 cannot be completely collected by taking up the first lengths of the web 2. However, the developed-up toner particles can be completely collected at regular intervals by taking up the second length of the web 2, which is longer than the first length.

This prevents toner particles from remaining developed up in the space 500 as in the conventional apparatus of FIGS. 6 and 7.

Areas occupied by the white lines, where the web 2 is not used, are wasteful. In the present embodiment, however, the web 2 is taken up not in such a manner as to form white lines constantly, but by switchable lengths such as to allow white lines to appear only at regular intervals. This improves cleaning capability of the web 2 while preventing an increase in running cost through effective use of the web 2.

The second number includes, but is not limited to, nine, and may not be necessarily set to a fixed value. The amount of toner debris generated on the roller 37A differs according to the density of image to be formed. It is possible to take up the web 2 at such an appropriate timing as to prevent developing up of too much toner debris in the space 500, by determining a timing when the web 2 is to be taken up according to the image density.

The first length includes, but is not limited to, 0.5 mm, and is preferably shorter than the length of the contact area. This is because the first length, if longer than the length of the contact area, causes wasteful taking up of the web 2. Also, it is preferable that a value obtained from multiplication of the first number and the first length is smaller than the length of the contact area in the cleaning position.

Further, the second length includes, but is not limited to, 3.0 mm. Preferably, the second length is sufficient to collect the toner particles developed up in the space 500 and is approximately equal to the length of the contact area. The second length, if shorter than the length of the contact area, may prevent complete removal of the developed-up toner debris. If too longer than the length of the contact area, in contrast, the second length causes wasteful taking up of the web 2.

Although, in the present embodiment, description has been made of an image forming apparatus capable of performing only black-and-white image formation, the invention is also applicable to an image forming apparatus capable of performing full-color image formation. In a full-color image forming apparatus, it is advisable to set the second length to different values in full-color and black-and-white image forming processes. For example, suppose a situation in which image forming processes having been performed includes at least one full-color image forming process by the time the number of the performed image forming processes reaches the second number. In this situation, it is advisable to set the second length larger than in a situation in which only black-and-white image forming processes have been performed.

In the present embodiment, the cleaning device 1 is applied to the roller 37A. Alternatively, the device 1 can be applied to the roller 37B.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaning device adapted, for use in an electrophotographic image forming apparatus, to clean a fuser roller provided in the apparatus, the cleaning device comprising:

a cleaning web for removing toner particles on a circumferential surface of the fuser roller, the cleaning web positioned in contact with the circumferential surface;

a supply roller having the cleaning web wound thereon;

a take-up roller for taking up the cleaning web withdrawn from the supply roller; and a control section for controlling rotation of the take-up roller, wherein the control section performs a first process of causing the take-up roller to take up a first length of the cleaning web each time a predetermined taking-up condition is satisfied, and performs a second process, instead of the first process, of causing the take-up roller to take up a second length of the cleaning web each time after a first predetermined number of the first processes are performed.

2. The cleaning device according to claim 1, wherein the taking-up condition is that a second predetermined number of image forming processes are performed.

3. The cleaning device according to claim 1, wherein the first length is shorter than a length of a portion of the cleaning web in contact with the fuser roller.

4. The cleaning device according to claim 1, wherein the first length and the first number are set in such a manner that a value obtained from multiplication of the first length and the first number is smaller than the length of the contact portion of the cleaning web.

5. The cleaning device according to claim 1, wherein the second length is equal to the length of the contact portion of the cleaning web.

6. A fusing device adapted for use in an electrophotographic image forming apparatus, the fusing device comprising:

a fuser roller for pressurizing and heating recording paper; and the cleaning device of claim 1.

7. An image forming apparatus adapted to perform an electrophotographic image forming process to recording paper based on image information, the apparatus comprising:

a fuser roller for pressurizing and heating recording paper; and the cleaning device of claim 1.

8. The image forming apparatus according to claim 7, wherein the taking-up condition is that a predetermined second number of image forming processes are performed, and the second number is set according to image density data included in the image information and size of recording paper for an image forming process to be performed to.

9. The image forming apparatus according to claim 8, wherein the second length is set according to image density data included in the image information and size of recording paper for an image forming process to be performed to.

* * * * *